United States Patent [19]

Koch et al.

[11] Patent Number: 5,037,536

[45] Date of Patent: Aug. 6, 1991

[54] VIBRATORY CONVEYING AND SEPARATING APPARATUS AND RELATED CLAMPING DEVICE

[75] Inventors: Ronald G. Koch, Milton-Freewater; Matthew G. Evans-Koch, Athena, both of Oreg.; Anthony J. Dickman, Dixie; David W. Allen, Walla Walla, both of Wash.

[73] Assignee: Key Technology, Inc., Walla Walla, Wash.

[21] Appl. No.: 496,819

[22] Filed: Mar. 21, 1990

[51] Int. Cl.[5] ..... B07B 1/28; B07B 1/46

[52] U.S. Cl. ..... 209/325; 209/399; 209/403; 209/405

[58] Field of Search ..... 209/325, 341, 342, 346, 209/365.1, 365.2, 365.3, 399, 403, 405, 329; 210/384, 388, 389

[56] References Cited

U.S. PATENT DOCUMENTS

| | | | |
|---|---|---|---|
| 1,242,982 | 10/1917 | Reynolds | 209/341 X |
| 1,397,343 | 11/1921 | Sturtevant | 209/403 |
| 1,933,561 | 11/1933 | Lunsford et al. | 209/405 |
| 2,118,782 | 5/1938 | Symons | 209/403 |
| 2,268,853 | 1/1942 | Behnke | 209/403 |
| 2,284,883 | 6/1942 | Symons | 209/403 |
| 2,345,364 | 3/1944 | Spafford | 92/30 |
| 2,378,499 | 3/1943 | Rapp | 209/329 X |
| 2,725,984 | 6/1950 | Klemencic | 209/365.1 |
| 2,974,798 | 3/1961 | Ruzicka | 209/365 |
| 3,092,573 | 6/1961 | Lambert et al. | 209/403 |
| 4,137,157 | 1/1979 | Deister et al. | 209/405 X |
| 4,430,211 | 2/1984 | Martin | 209/314 |
| 4,655,907 | 4/1987 | Ando | 209/404 |

*Primary Examiner*—Donald T. Hajec
*Assistant Examiner*—Joseph A. Kaufman
*Attorney, Agent, or Firm*—Wells, St. John & Roberts

[57] ABSTRACT

A vibratory conveying and separating apparatus and a clamping device therefor are disclosed. The apparatus includes a conveyor bed which supports processing screens which convey and separate material being processed. The bed is vibrated in a forward and upward direction at a predetermined forward and upward angle of inclination. At least one releasable clamping device engages between the conveyor bed and processing screen to provide a releasable clamping force against the screen for clamping it to the conveyor bed. The clamp is mounted or positioned to orient the releasable clamping force substantially parallel with the predetermined forward and upward angle of inclination.

25 Claims, 6 Drawing Sheets

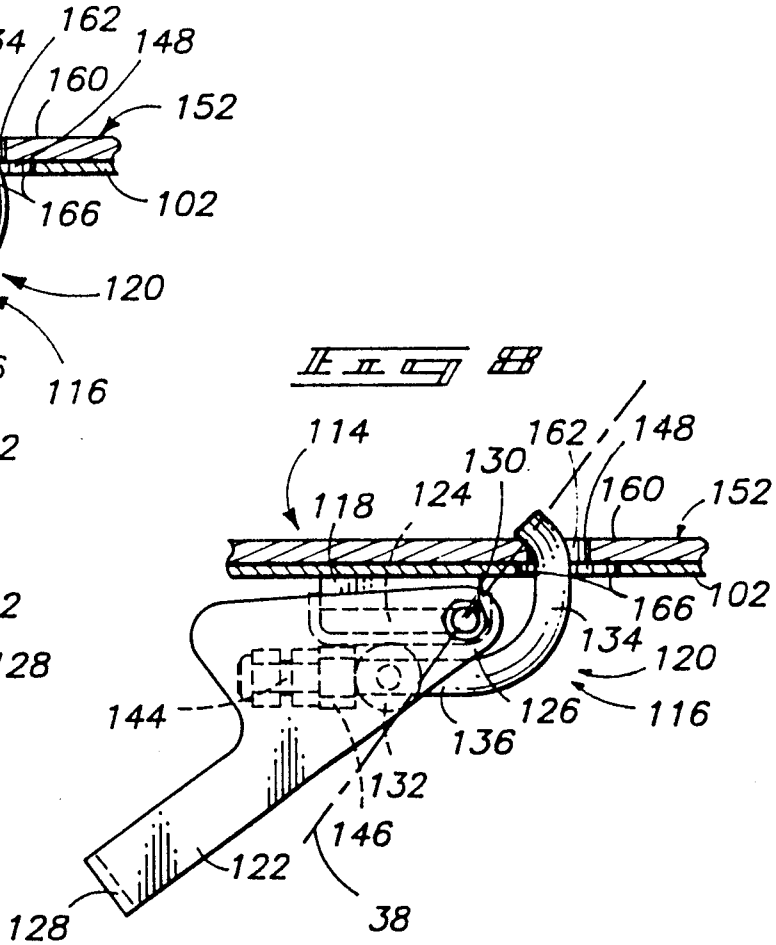
FIG. 7
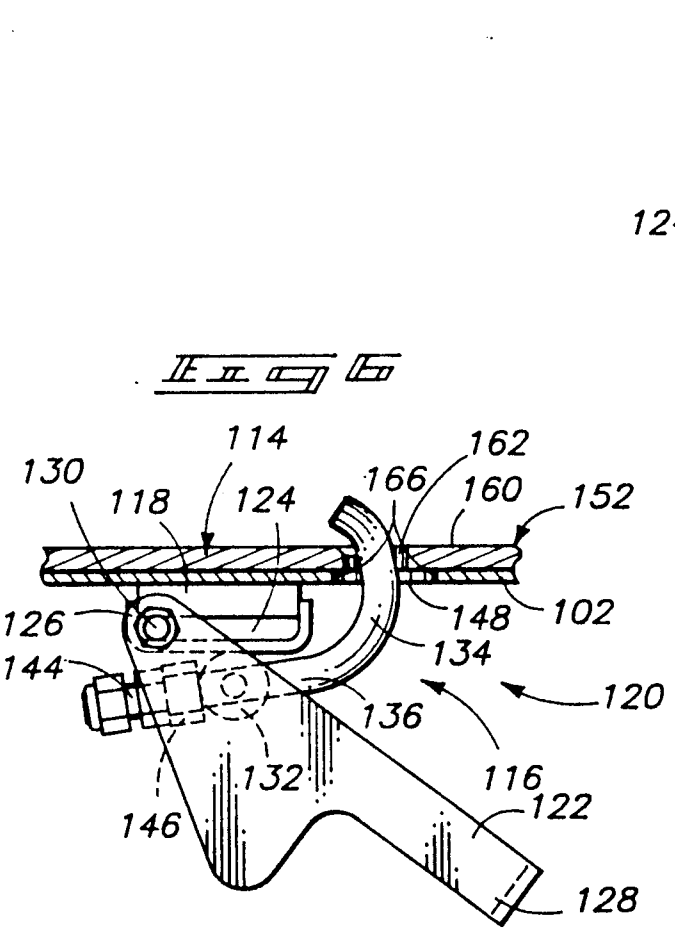
FIG. 6
FIG. 8

VIBRATORY CONVEYING AND SEPARATING APPARATUS AND RELATED CLAMPING DEVICE

TECHNICAL FIELD

This invention relates generally to vibratory conveying and separating apparatus having replaceable screens which are driven by a vibratory drive that vibrates the screens in a forward and upward direction.

BACKGROUND OF THE INVENTION

Vibratory conveyors and shakers are commonly used for dewatering, separating and grading various material, such as for example fruits and vegetables. Conventionally, such conveyors comprise a working conveyor bed mounted to a frame, and a vibratory exciter arranged to impart vibrating motion to the conveyor bed. The conveyor bed is provided with a screen deck which is conventionally a rigid apertured bed made up of a plurality of screening panels. The screening panels are removably mounted to the conveyor bed frame such that different mesh panels can be substituted depending upon the material being processed, and for replacement of the screens upon excessive wear. A great challenge in the design and maintenance of such conveyors is to provide a bed which enables the screen panels to be rigidly held in place relative to the conveyor bed, and yet easily removed when one desires to change a screen.

One existing prior art method for maintaining the screen panels in their desired positions relative to a conveyor bed is illustrated in FIG. 3. FIG. 3 is a vertical and partial section view of a conveyor bed 10 illustrating a screen panel 12 being clamped relative thereto by a prior art clamping device 14. The product being processed and conveyed by conveyor bed 10 would move into the page upon which FIG. 3 appears. Clamp 14 is vertically oriented, and the vibratory drive (not shown) would vibrate bed 10 and screens 12 upwardly and forwardly at an inclined angle generally into the direction of the page. Clamp 14 includes a hook member 16 which is pivotally mounted relative to a lever arm 18 and a mounting base 20 for imparting a vertically downward clamping force against screen 12. Screen 12 is clamped vertically downward against an inner side rail 36 of conveyor bed 10.

More particularly, mounting base 20 is welded or otherwise secured to the external surface of conveyor bed frame 10. Base 20 pivotally supports lever arm 18 relative thereto at one of the lever arm ends for pivoting about a horizontal axis 22. Hook member 16 is also pivotally mounted relative to lever arm 18 by a horizontal pivot rod 24. Hook 16 is threaded at its lower end and threadably receives a tension adjustable nut 28. A tension spring 26 is received between pivot rod 24 and nut 28.

The upper hooking portion of hook member 16 is received through a side opening 30 which is formed in conveyor bed frame 10. Opening 30 is elongated in the vertical direction to accommodate the insertion and removal of hook 16 therethrough the result of the vertical arcing movement of the upper portion of hook 16 by pivot action about pivot axis 22. This would otherwise create a large opening in the side of conveyor bed 10 through which some of the material being processed would fall to the ground and be lost. To eliminate this loss of product, a bent metal guard 32 is affixed to the internal surface of conveyor bed frame 10 and covers opening 30. Guard 32 is secured to frame 10 at its upper end and includes an upwardly angled portion 34 at its lower end against which hook 16 bears. This lower portion 34 is slidable relative to bed frame 10 such that a clamping force applied against lower portion 34 will be transmitted vertically downward onto screen 12. Guard 32 and the position of hook 16 provide a disadvantage of projecting into the processing path of the material being conveyed. This reduces the effective width of the processing bed.

Typically, two of such clamps would be provided on each side of each individual screen panel of a conveyor bed. A camming-lock clamping action is provided by lever arm 18 and pivot rod 24 relative to mounting block 20. A locking clamp force is provided by camming action when pivot rod 24 is rotated to a location beneath an imaginary line 38 defined by the tip of clamp hook 16 and pivot axis 22.

Such conveyor beds are not without disadvantages. For example, the excessive vibratory force necessary to impart the conveying action has been found on occasion to cause mounting blocks 20 to separate relative to conveyor bed frame 10. Further, the downward clamping force must be large as it must clamp the screen relative to the bed which is being vibrated with a force having another directional component. Further, the orientation of hook 16 and guard 32 relative to conveyor bed 10 reduces the effective width of the processing conveyor, as previously described.

BRIEF DESCRIPTION OF THE DRAWINGS

The preferred embodiment of the invention is illustrated in the accompanying drawings, in which:

FIGS. 6, 7 and 8 correspond to FIG. 5 in view orientation, and illustrate sequential clamping of a releasable clamp relative to a conveyor bed of a vibratory conveying and separating apparatus in accordance with the invention.

DETAILED DESCRIPTION OF THE PREFERRED EMBODIMENTS

The following disclosure of the invention is submitted in furtherance with the constitutional purpose of the Patent Laws "to promote the progress of science and useful arts" (Article 1, Section 8).

Figure 1:
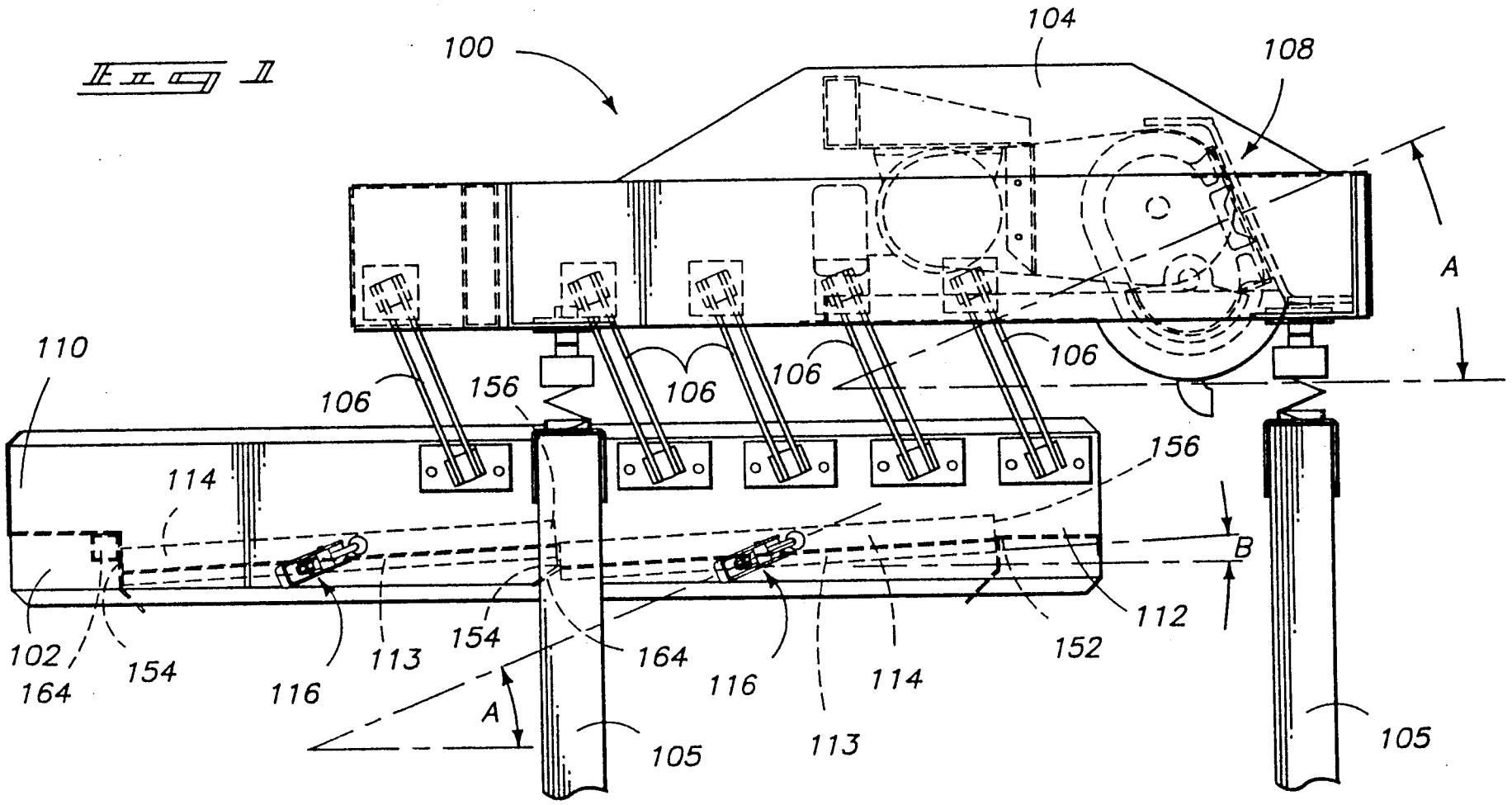
FIG. 1 is a side elevational view of a vibratory conveying and separating apparatus in accordance with the invention.
Figure 2:
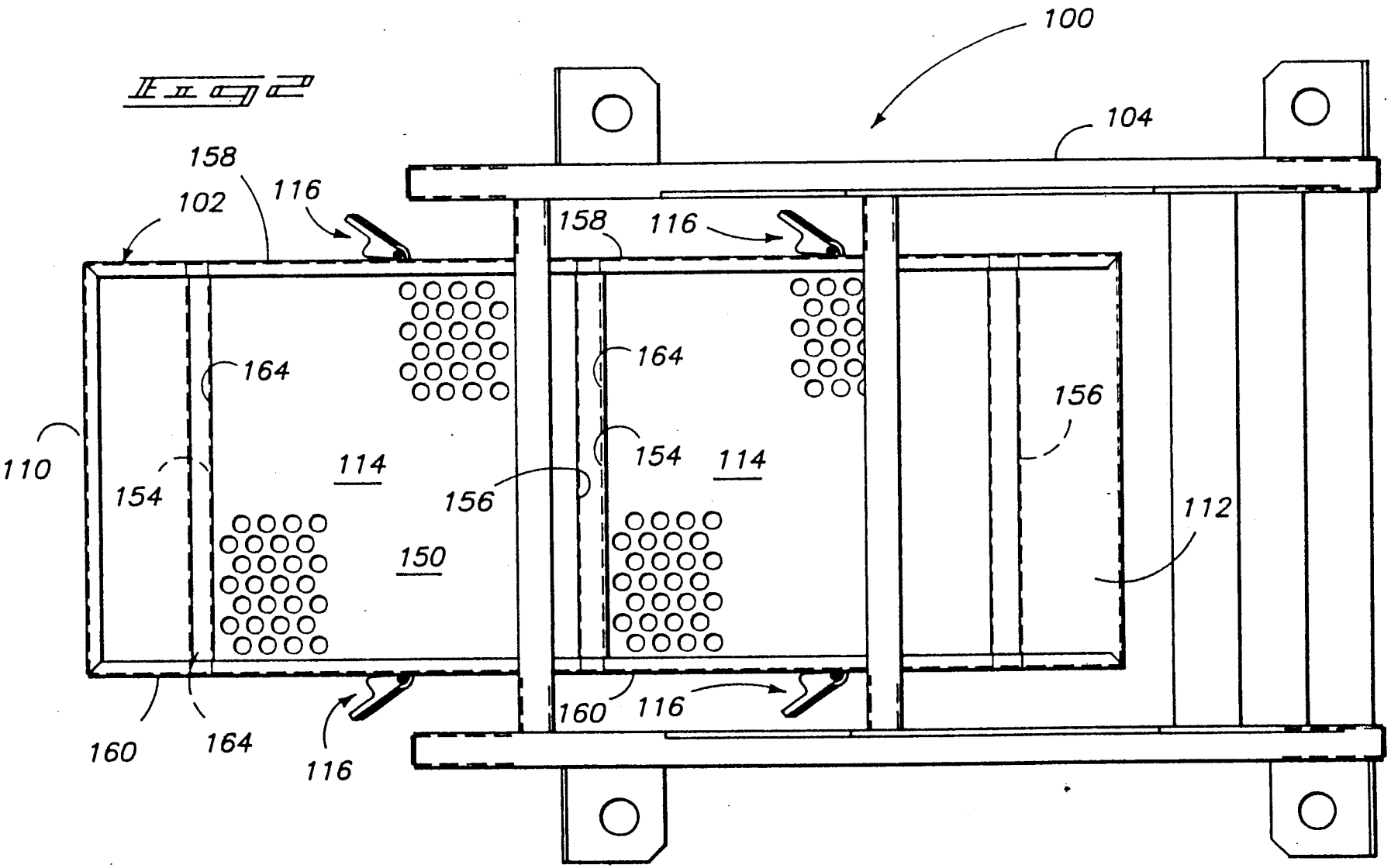
FIG. 2 is a top or overhead view of the vibratory conveying and separating apparatus of FIG. 1.
Figure 3:
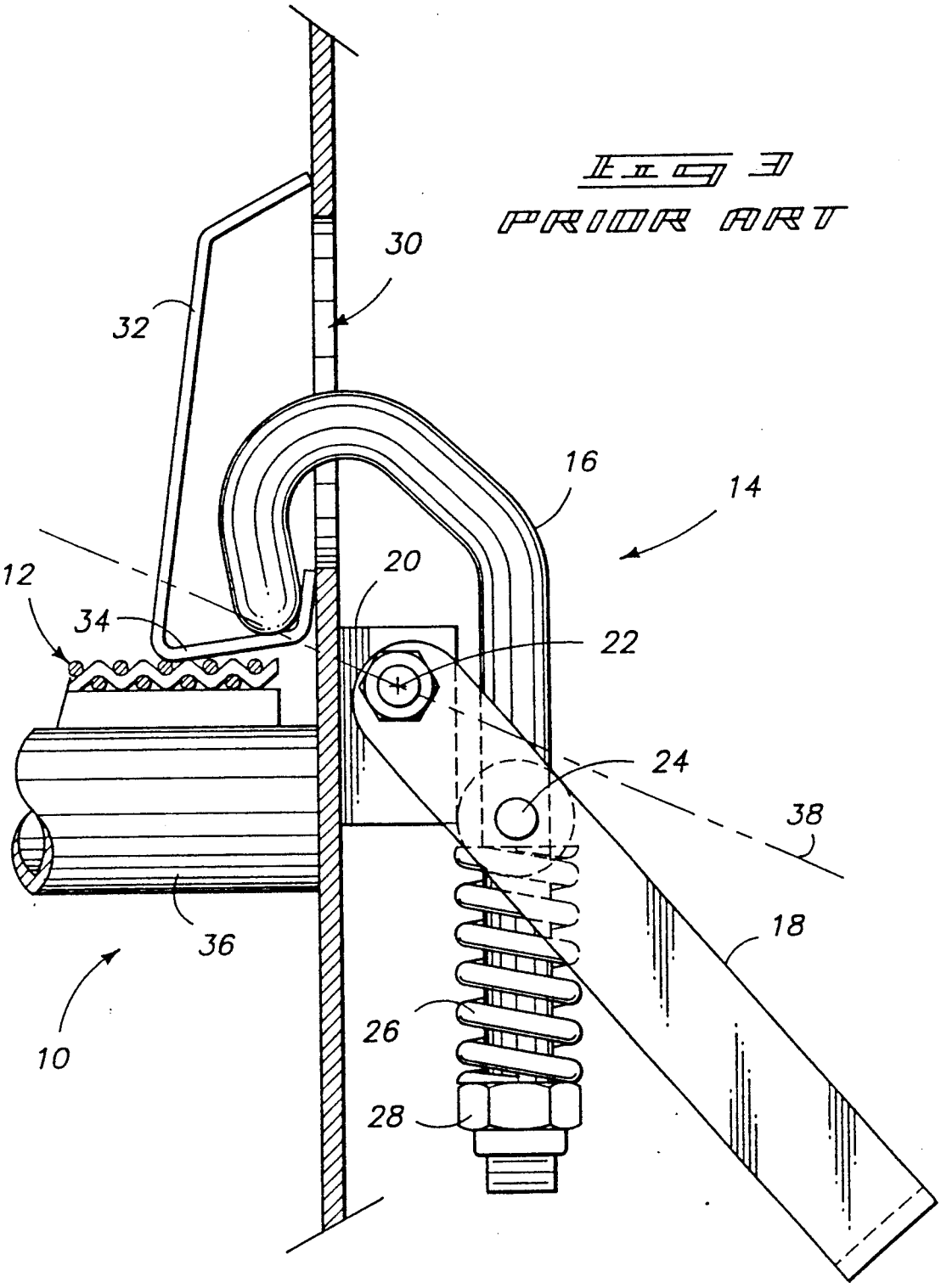
FIG 3 PRIOR ART
FIG. 3 is a vertical partial sectional view of a prior art conveyor bed and clamping device as described in the Background section above.

Referring to FIGS. 1 and 2, a vibratory conveying and separating apparatus in accordance with the invention is indicated generally by reference numeral 100. Vibratory conveyor 100 includes a conveyor bed 102 and an overhead vibratory drive frame assembly 104.

Vibratory drive frame assembly 104 is supported by vertical supports 105.

Conveyor bed 102 and drive assembly 104 are interconnected by a series of leaf springs 106 which function as a support means for resiliently supporting conveyor bed 102 for vibration. (The support springs have been removed from FIG. 2 for clarity). Drive frame assembly 104 includes a drive means 108 for vibrating conveyor bed 102 through leaf springs 106 in a forward and upward direction at a predetermined forward and upward angle of inclination "A" alternately termed the upward vibration angle. This angle of inclination A is preferably approximately 22.5 degrees relative to horizontal, with leaf springs 106 being oriented substantially normal to the predetermined angle of inclination. Drive means 108 preferably applies a substantially linear vibratory drive force along the forward and upward inclination angle. Of course, alternative drives and conveyor bed assemblies could be usable without departing from the principles and scope of the invention, as will be apparent from the continuing discussion and concluding claims.

Conveyor bed 102 is generally rectangular in shape having a rearward infeed end 110 and a forward discharge end 112. Supported internally within the frame of conveyor bed 102 are processing screens 114 which receive, convey and separate material being processed. Processing screens 114 have a general horizontal orientation, yet are positioned at a slight prescribed forwardly inclined screen angle "B" (FIG. 1). Such general horizontal orientation requires that drive assembly 104 convey the material being processed across the generally horizontal processing screens as well as provide a shaking function thereto to effect separation of small size material through the screens. As is apparent from the drawings, vibration angle "A" is different and greater than prescribed screen angle "B". Conventional prior art support rails 113 are provided for supporting processing screen 114 at a slight upward and forward angle of inclination relative to the general horizontal orientation of bed 102.

At least one releasable clamp 116 engages between conveyor bed 102 and each processing screen 114 to provide a releasable clamping force against the screen to clamp it to the conveyor bed. The clamp is mounted to orient the releasable clamping force substantially parallel with the predetermined forward and upward angle of inclination A. This provides an advantage of reducing the wear on the clamping components by aligning the clamping force with the vibratory force. This minimizes any lateral movement and forces from being applied to the clamping device. In the illustrated and preferred embodiment, only one clamp 116 engages each of the opposite sides of each processing screen 114 the result of the alignment of the clamping force and vibratory force.

Figure 4:
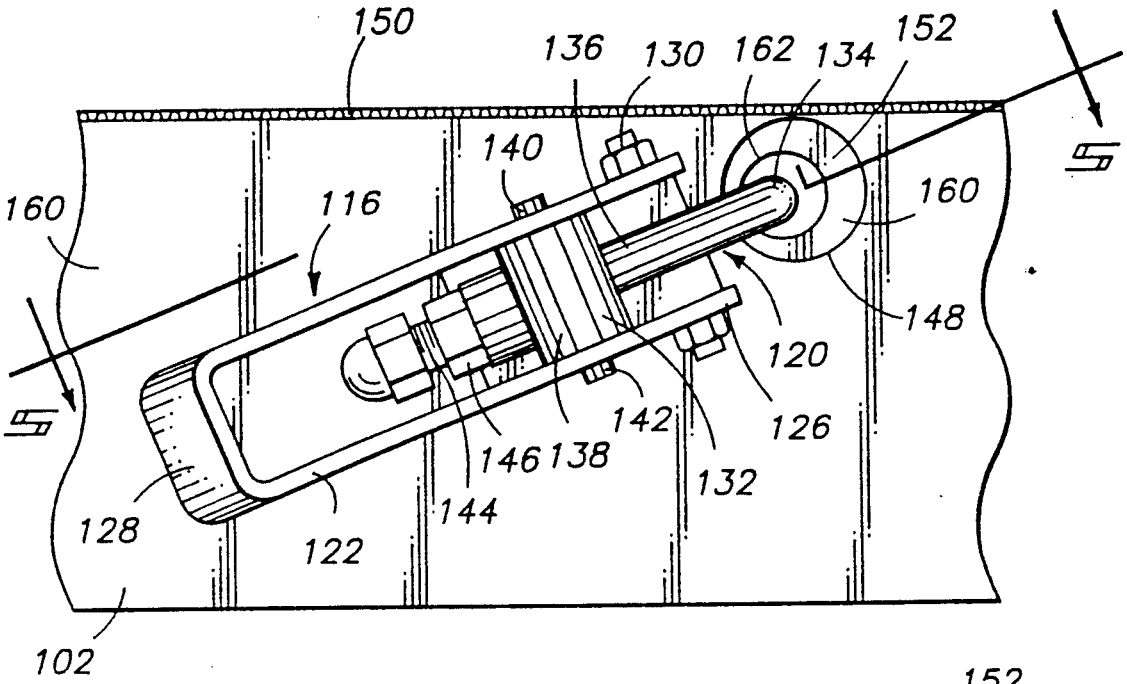
FIG. 4 is an enlarged side fragmentary elevational view of a portion of the vibratory conveying and separating apparatus of FIG. 1.
Figure 5:
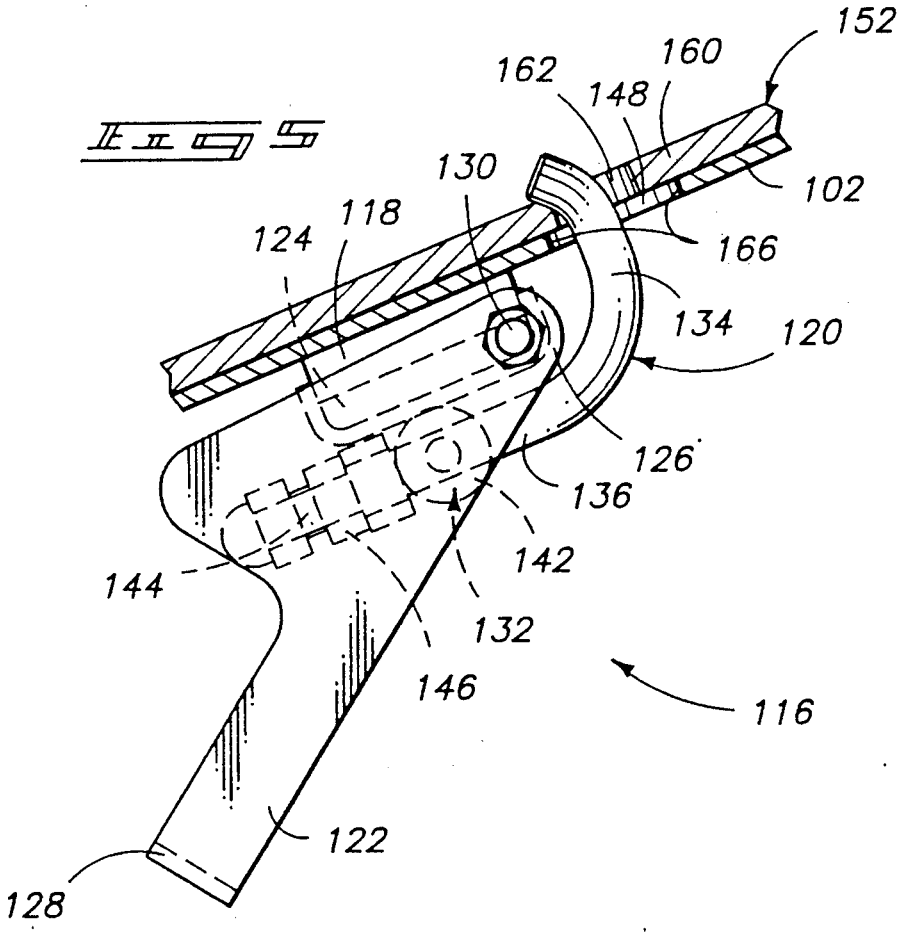
FIG. 5 is a downward partial sectional view taken through angled lines 5—5 in FIG. 4.

Referring more particularly to FIGS. 4 and 5, clamp device 116 is mounted to the side of conveyor bed 102. Clamp 116 is defined by a mounting base 118, a clamp hook 120 and a pivotally interconnecting elongated lever arm 122. Mounting base 118 is welded or otherwise secured to the side of conveyor bed 102, and is provided with a longitudinally elongated slot 124. Lever arm 122 has a rough outline shape similar in appearance to the numeral "4", as shown in FIG. 5. It has first and second ends 126, 128, respectively. As illustrated by FIG. 4, lever arm 122 in edge view is in the shape of a "U".

Lever arm 122 operably engages mounting base 118 by a first pivot rod nut and bolt assembly 130 which extends across first end 126, and into and through mounting base slot 124. A second pivot rod 132 is received by lever arm 122 intermediate first pivot rod 130 and second lever arm end 128. Second pivot rod 132 operably engages clamp hook 120 for pivotally supporting clamp hook 120 and lever arm 124 relative to one another.

More particularly, clamp hook 120 includes a hook portion 134 and a stem portion 136 extending therefrom. Second pivot rod 132 is defined by a large central section 138 and smaller outer opposing pins 140 and 142 which are pivotally received within aligned holes formed on the opposing sides of lever arm 122. A transverse hole is provided within large central section 138 in second pivot rod 132 through which stem portion 136 of clamp hook 120 slidably extends. In this manner, hook 120 is slidably received relative to second pivot rod 132.

External threads 144 are formed on the lower end of stem portion 136. Threads 144 threadably receive an adjustable tension nut assembly 146. Nut assembly 146 is longitudinally moveable along stem 136 by rotation of the nut relative to the external stem threads 144 to adjust the clamping tension of clamp hook 120, as will be more fully described below. Nut assembly 146 in operation bears perpendicularly relative to central portion 138 of second pivot rod 132. Nut assembly 146 and threads 144 define an adjustable locking means for restricting movement of stem 136 relative to second pivot rod 132 when clamping hook 120 is in a clamping position. They also provide a means for adjusting the clamping force applied against screen 114 as will be apparent from the continuing discussion.

Conveyor bed 102 is provided with a side clamp opening 148, with clamp mounting base 118 being mounted adjacent thereto such that clamp hook portion 134 is extendable through opening 148.

Processing screens 114 are generally rectangular in shape being defined by a perforated sheet 150 supported by a screen frame 152. Each processing screen 114 includes a rearward and forward end 154, 156, respectively, and opposing outer first and second screen sides 158, 160, respectively. (FIGS. 1, 2, 4, and 5) Clamp hook 120 engages relative to the side of screen frame 152 and at a location beneath perforated sheet 150.

More particularly, screen frame 152 includes a side frame opening 162 which is smaller in diameter than conveyor bed opening 148. Side frame opening 162 is positioned on screen frame 152 to generally align with side clamp opening 148 when screen 114 is supported by conveyor bed 102. Clamp hook 120 in operation extends through side clamp opening 148 and into side frame opening 152. Conveyor bed 102 is provided with screen abutments 164 which are positioned to engage one of the rearward or forward screen ends, and are aligned perpendicular to the predetermined forward and upward angle of inclination A (FIGS. 1 and 2.). In the illustrated and preferred embodiment, clamps 116 are mounted relative to conveyor bed 102 to force a screen frame 152 rearwardly against abutments 164 to provide a clamping force which is substantially parallel to the angle of inclination of the applied vibratory force A.

Reference is now made to FIGS. 6, 7 and 8 for a brief discussion of operation of clamp 116. Referring first to FIG. 6, a screen 114 would be positioned relative to conveyor bed 102 to appropriately align screen opening 162 with the clamp opening 148 in bed 102. Lever arm 122 would be pivoted and positioned as shown in FIG. 6 such that pivot rod 130 is at the back or lower portion of mounting base slot 124. This will enable hook portion 134 to be pivoted about second pivot rod 132 such that it will be easily inserted through the side of conveyor bed 102 and into screen opening 162.

Referring next to FIG. 7, inward pressure is maintained with the user's finger or otherwise on hook portion 134, and lever arm 122 rotated and slid until first pivot rod 130 is in the forward or upward portion of mounting base slot 124. At this point, nut assembly 146 is threaded relative to hook stem 136 as necessary until lever arm 122 is approximately perpendicular relative to the side of conveyor bed 102. At this point, tension should be felt on hook 120. The proper positioning and adjustment is illustrated by FIG. 7.

From this point, lever arm 122 is pulled or pushed downwardly toward the side of bed 102 until hook pivot rod 132 "cams over" imaginary line 38 (FIG. 8) and clamps down into a holding position.

The clamp would be released by first grasping the handle and rotating it away from the side of conveyor bed 102 until it is positioned substantially perpendicularly relative to conveyor bed 102 as shown in FIG. 7 at which point tension will be completely released. Lever arm 122 and first pivot rod 130 are then slid rearwardly along slot 124 in mounting base 118. Hook portion 134 can then be pivoted and removed from screen 114. Greater tightening of nut assembly 146 results in greater tension of the applied clamping force.

Figure 9:
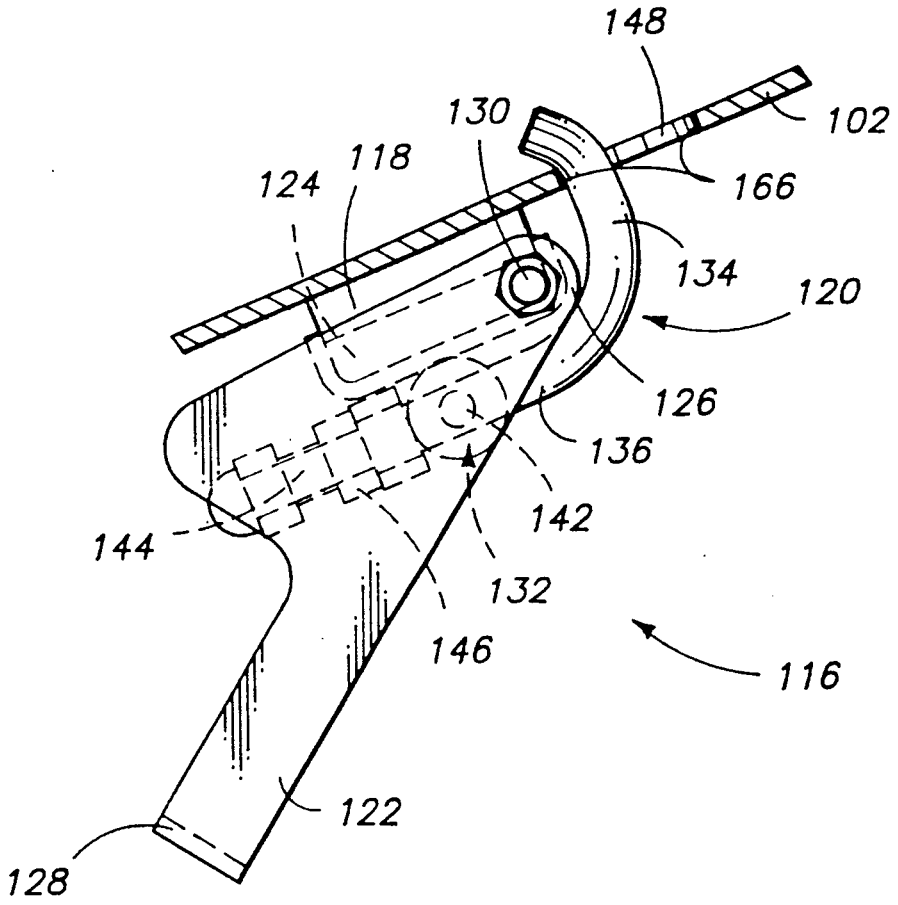
FIG. 9 corresponds to FIG. 5 in view orientation, and illustrates operation of a clamping device in accordance with the invention where a screen has been removed from the conveyor bed of an inventive vibratory conveying and separating apparatus.

Referring to FIG. 9, hook 120 can be clamped relative to conveyor bed opening 148 when the screen is removed if nut assembly 146 is threaded sufficiently far enough up stem 136 of hook 120 to provide a clamping force where there is no screen. As shown, hook portion 134 is clamped against internal side surfaces 166 of conveyor bed opening 148.

In compliance with the statute, the invention has been described in language more or less specific as to structural features. It is to be understood, however, that the invention is not limited to the specific features shown and described, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

We claim:

1. A vibratory conveying and separating apparatus comprising:

a conveyor bed having a rearward infeed end and a forward discharge end, the conveyor bed including means for supporting at least one processing screen at a prescribed screen angle of general horizontal orientation which conveys and separates material being processed;

support means for resiliently supporting the conveyor bed for vibration;

drive means for vibrating the conveyor bed in a forward and upward direction at a predetermined inclined forward and upward vibration angle to convey material being processed across the generally horizontal processing screen, the vibration angle being greater than the prescribed screen angle; and at least one releasable clamp engaging between the conveyor bed and the processing screen to provide a releasable clamping force against the screen to clamp it to the conveyor bed, the clamp being mounted to orient the releasable clamping force substantially parallel with the predetermined inclined forward and upward vibration angle.

2. The vibratory conveying and separating apparatus of claim 1 wherein the processing screen supported by the conveyor bed includes a rearward end and a forward end, the conveyor bed including a screen abutment positioned to engage one of the rearward or forward screen ends, the abutment being aligned perpendicular to the predetermined inclined forward and upward vibration angle.

3. The vibratory conveying and separating apparatus of claim 1 wherein each processing screen supported by the conveyor bed includes first and second screen sides, and wherein only a single clamp engages each side of each screen.

4. The vibratory conveying and separating apparatus of claim 1 wherein the drive means applies a substantially linear vibratory drive force in the forward and upward direction.

5. The vibratory conveying and separating apparatus of claim 1 wherein the predetermined vibration angle is approximately 22.5° relative to horizontal.

6. The vibratory conveying and separating apparatus of claim 1 wherein the support means comprises leaf spring which mount the conveyor bed relative to the drive means.

7. The vibratory conveying and separating apparatus of claim 6 wherein the leaf springs are oriented substantially normal to the predetermined upward vibration angle.

8. The vibratory conveying and separating apparatus of claim 1 wherein, the processing screen supported by the bed includes a perforated sheet supported by a screen frame;

the conveyor bed includes a side and a side clamp opening extending therethrough, the clamp being mounted to the conveyor bed adjacent the side clamp opening;

the conveyor bed defining a processing path through which material being processed is conveyed; and the clamp includes a clamp hook which extends through the side clamp opening and engages the screen frame at a location beneath the perforated sheet, the clamp nowhere extending into the processing path elevationally above the processing screen.

9. A vibratory conveying and separating apparatus comprising:

a conveyor bed having a rearward infeed end and a forward discharge end, the conveyor bed including means for supporting at least one processing screen which conveys and separates material being processed;

support means for resiliently supporting the conveyor bed for vibration;

drive means for vibrating the conveyor bed in a forward and upward direction at a predetermined forward and upward angle of inclination;

at least one releasable clamp engaging between the conveyor bed and the processing screen to provide a releasable clamping force against the screen to clamp it to the conveyor bed, the clamp being mounted to orient the releasable clamping force substantially parallel with the predetermined forward and upward angle of inclination;

the processing screen supported by the bed including a perforated sheet supported by a screen frame;

the conveyor bed including a side and a side clamp opening extending therethrough, the clamp being mounted to the conveyor bed adjacent the side clamp opening;

the clamp includes a clamp hook which extends through the side clamp opening and engages the screen frame at a location beneath the perforated sheet; and wherein the screen frame supported by the bed includes sides, the screen frame including a side frame opening extending through at least one of the screen sides, the side frame opening being positioned on the screen frame to align with the side clamp opening when the screen is supported by the conveyor bed.

10. The vibratory conveying and separating apparatus of claim 1 wherein, the processing screen supported by the bed includes a perforated sheet supported by a screen frame, the screen frame having outer sides;

the conveyor bed includes a side and a side clamp opening extending therethrough, the clamp being mounted to the conveyor bed adjacent the side clamp opening;

the conveyor bed defining a processing path through which material being processed is conveyed; and the clamp includes a clamp hook which extends through the side clamp opening and engages a screen frame outer side, the clamp nowhere extending into the processing path elevationally above the processing screen.

11. A vibratory conveying and separating apparatus comprising:

a conveyor bed having a rearward infeed end and a forward discharge end, the conveyor bed including means for supporting at least one processing screen which conveys and separates material being processed;

support means for resiliently supporting the conveyor bed for vibration;

drive means for vibrating the conveyor bed in a forward and upward direction at a predetermined forward and upward angle of inclination;

at least one releasable clamp engaging between the conveyor bed and the processing screen to provide a releasable clamping force against the screen to clamp it to the conveyor bed, the clamp being mounted to orient the releasable clamping force substantially parallel with the predetermined forward and upward angle of inclination;

the processing screen supported by the bed including a perforated sheet supported by a screen frame, the screen frame having outer sides;

the conveyor bed including a side and a side clamp opening extending therethrough, the clamp being mounted to the conveyor bed adjacent the side clamp opening;

the clamp including a clamp hook which extends through the side clamp opening and engages a screen outer side; and wherein the screen frame supported by the bed includes at least one side frame opening in at least one of the outer sides, the side frame opening being positioned on the screen frame to align with the side clamp opening when the screen is supported by the conveyor bed, the clamp hook in operation extending through the side clamp opening and into the side frame opening and clamping the screen against the conveyor bed.

12. The vibratory conveying and separating apparatus of claim 1 wherein the conveyor bed includes a side and a side clamp opening extending therethrough, the side clamp opening having internal side surfaces, the clamp including a clamp hook which extends through the side clamp opening, the clamp being mounted to the conveyor bed adjacent the side clamp opening to enable the clamp hook to be clamped against the internal side surfaces when not in use.

13. A vibratory conveying and separating apparatus comprising:

a conveyor bed having a rearward infeed end and a forward discharge end, the conveyor bed including means for supporting at least one processing screen which conveys and separates material being processed;

support means for resiliently supporting the conveyor bed for vibration;

drive means for vibrating the conveyor bed in a forward and upward direction at a predetermined forward and upward angle of inclination; and at least one releasable clamp engaging between the conveyor bed and the processing screen to provide a releasable clamping force against the screen to clamp it to the conveyor bed, the clamp being mounted to orient the releasable clamping force substantially parallel with the predetermined forward and upward angle of inclination. wherein the releasable clamp comprises:

a mounting base having an elongated slot;

an elongated lever arm having first and second ends, the lever arm operably engaging the mounting base;

a clamp hook operably engaging the lever arm;

a first pivot rod received by the lever arm adjacent the first lever arm end and extending into the mounting base slot, the first pivot rod joining the lever arm and mounting base and being pivotal within the mounting base slot and slidable therealong; and a second pivot rod received by the lever arm intermediate the first pivot rod and the second lever arm end, the second pivot rod engaging the clamp hook for pivotally supporting the clamp hook and lever arm relative to one another.

14. The vibratory conveying and separating apparatus of claim 13 wherein the clamp hook includes a hook portion and a stem portion extending therefrom, the stem portion being slidably received relative to the second pivot rod and including adjustable locking means for restricting movement of the stem relative to the second pivot rod when the clamping hook is in a clamping position.

15. The vibratory conveying and separating apparatus of claim 14 wherein the adjustable locking means comprises external threads formed on the stem portion and an adjustable tension nut threadably received thereby, the nut being longitudinally movable along the stem by rotation of the nut relative to the external stem threads to adjust the clamping tension of the clamp hook, the nut in operation bearing perpendicularly relative to the second pivot rod.

16. A vibratory conveying and separating apparatus comprising:

a conveyor bed having a rearward infeed end and a forward discharge end, the conveyor bed including means for supporting at least one processing screen which conveys and separates material being processed;

support means for resiliently supporting the conveyor bed for vibration;

drive means for vibrating the conveyor bed in a forward and upward direction at a predetermined forward and upward angle of inclination; and at least one releasable clamp engaging between the conveyor bed and the processing screen to provide a releasable clamping force against the screen to clamp it to the conveyor bed, the clamp being mounted to orient the releasable clamping force substantially parallel with the predetermined forward and upward angle of inclination;

the processing screen supported by the bed includes a perforated sheet supported by a screen frame, the screen frame having a rearward end and a forward end, the conveyor bed including a screen abutment positioned to engage one of the rearward or forward frame ends, the abutment being aligned perpendicular to the predetermined forward and upward angle of inclination;

the conveyor bed includes a side and a side clamp opening extending therethrough, the clamp being mounted to the conveyor bed adjacent the side clamp opening; and the clamp includes a clamp hook which extends through the side clamp opening and engages the screen frame at a location beneath the perforated sheet and forcing the screen frame against the abutment.

17. The vibratory conveying and separating apparatus of claim 16 wherein the screen frame supported by the bed includes sides, the screen frame including a side frame opening extending through one of the bed sides, the side frame opening being positioned on the screen frame to align with the side clamp opening when the screen is supported by the conveyor bed, the clamp hook in operation extending through the side clamp opening and into the side frame opening.

18. The vibratory conveying and separating apparatus of claim 16 wherein the side clamp opening has internal side surfaces, the clamp hook extending through the side clamp opening and being capable of being clamped against the internal side surfaces when not in use.

19. The vibratory conveying and separating apparatus of claim 1 wherein, the processing screen supported by the bed includes a perforated sheet supported by a screen frame;

the conveyor bed defining a processing path through which material being processed is conveyed; and the clamp includes a clamp hook, the clamp hook in operation engaging the screen frame at a location beneath the perforated sheet, the clamp nowhere extending into the processing path elevationally above the processing screen.

20. The vibratory conveying and separating apparatus of claim 1 wherein, the processing screen supported by the bed includes a perforated sheet supported by a screen frame;

the conveyor bed includes a side and a side clamp opening extending therethrough, the clamp being mounted to the conveyor bed adjacent the clamp opening;

the conveyor bed defining a processing path through which material being processed is conveyed; and the clamp includes a clamp hook which extends through the clamp opening, the clamp hook in operation engaging a screen outer side at a location beneath the perforated sheet, the clamp nowhere extending into the processing path elevationally above the processing screen.

21. A vibratory conveying and separating apparatus comprising:

a conveyor bed having a rearward infeed end and a forward discharge end, the conveyor bed including means for supporting at least one processing screen which conveys and separates material being processed;

support means for resiliently supporting the conveyor bed for vibration;

drive means for vibrating the conveyor bed in a forward and upward direction at a predetermined forward and upward angle of inclination; and at least one releasable clamp engaging between the conveyor bed and the processing screen to provide a releasable clamping force against the screen to clamp it to the conveyor bed, the clamp being mounted to orient the releasable clamping force substantially parallel with the predetermined forward and upward angle of inclination;

the processing screen supported by the bed includes a perforated sheet supported by a screen frame, the screen frame having an external opening formed therein;

the conveyor bed includes a clamp opening, the clamp being mounted to the conveyor bed adjacent the clamp opening; and the clamp includes a clamp hook which extends through the clamp opening, the clamp hook in operation extending into the external opening and clamping the screen against the conveyor bed.

22. A vibratory conveying and separating apparatus comprising:

a conveyor bed having a rearward infeed end, a forward discharge end, a side, a side clamp opening, and an abutment;

the conveyor bed including means for supporting at least one processing screen which conveys and separates material being processed; the processing screen including a perforated sheet supported by a screen frame; the screen frame including a rearward end, a forward end, a side, and a side frame opening extending through the screen side, the side frame opening being positioned on the screen frame to align with the side clamp opening when the screen is supported by the conveyor bed;

support means for resiliently supporting the conveyor bed for vibration;

drive means for vibrating the conveyor bed in a forward and upward direction at a predetermined forward and upward angle of inclination; and at least one clamp mounted to the conveyor bed adjacent the side clamp opening for engaging between the conveyor bed and the screen frame beneath the perforated sheet to provide a releasable clamping force against the screen to clamp it against the conveyor bed abutment, the clamp being mounted to the conveyor bed to orient the releasable clamping force substantially parallel with the predetermined forward and upward angle of inclination, the clamp comprising:

a mounting base mounted to the conveyor bed, the mounting base having an elongated slot;

an elongated lever arm having first and second ends, the lever arm operably engaging the mounting base;

a clamp hook operably engaging the lever arm and having a hook portion and a stem portion, the hook portion in operation extending through the side clamp opening and into the side frame opening of a processing screen supported by the conveyor bed;

a first pivot rod received by the lever arm adjacent the first lever arm end and extending into the mounting base slot, the first pivot rod joining the lever arm and mounting base, and being pivotal within the mounting base slot and slidable therealong;

a second pivot rod received by the lever arm intermediate the first pivot rod and the second lever arm end, the second pivot rod slidably receiving the stem portion of the clamp hook and pivotally supporting the clamp hook and lever arm relative to one another; and adjustable locking means for restricting movement of the stem relative to the second pivot rod when the clamping hook is in a clamping position.

23. The vibratory conveying and separating apparatus of claim 22 wherein the adjustable locking means comprises external threads formed on the stem portion and an adjustable tension nut threadably received thereby, the nut being longitudinally movable along the stem by rotation of the nut relative to the external stem threads to adjust the clamping tension of the clamp hook, the nut in operation bearing perpendicularly relative to the second pivot rod.

24. For a vibratory conveying and separating apparatus having a conveyor bed comprising a rearward infeed end and a forward discharge end; the conveyor bed further including means for supporting at least one processing screen which conveys and separates material being processed, the processing screen including a perforated sheet supported by a screen frame; the apparatus further having support means for resiliently supporting the conveyor bed for vibration and drive means for vibrating the conveyor bed in a forward and upward direction at a predetermined forward and upward angle of inclination, a clamping device for engaging between the conveyor bed and the processing screen to provide a releasable clamping force against the screen which is substantially parallel with the predetermined forward and upward angle of inclination, the clamping device comprising:

a base for mounting to the conveyor bed, the base having an elongated slot;

an elongated lever arm having first and second ends, the elongated lever arm operably engaging the base;

a clamp hook operably engaging the lever arm and having a hook portion and a stem portion, the hook portion in operation engaging the screen frame;

a first pivot rod received by the lever arm adjacent the first lever arm end and extending into the base slot, the first pivot rod joining the lever arm and base, and being pivotal within the base slot and slidable therealong;

a second pivot rod received by the lever arm intermediate the first pivot rod and the second lever arm end, the second pivot rod slidably receiving the stem portion of the clamp hook and pivotally supporting the clamp hook and lever arm relative to one another; and adjustable locking means for restricting movement of the stem relative to the second pivot rod when the clamping hook is in a clamping position.

25. The clamping device of claim 24 wherein the adjustable locking means comprises external threads formed on the stem portion and an adjustable tension nut threadably received thereby, the nut being longitudinally movable along the stem by rotation of the nut relative to the external stem threads to adjust the clamping tension of the clamp hook, the nut in operation bearing perpendicularly relative to the second pivot rod.

* * * * *